United States Patent [19]

Hildebrand et al.

[11] 3,984,950

[45] Oct. 12, 1976

[54] MODULAR BUILDING UNITS

[75] Inventors: Mark L. Hildebrand, New Haven; Henry A. Rudkin, Jr., Fairfield; Nathaniel C. Wiley, Jr., Weston, all of Conn.

[73] Assignee: Rudkin-Wiley Corporation, Stratford, Conn.

[22] Filed: Aug. 31, 1973

[21] Appl. No.: 393,463

Related U.S. Application Data

[63] Continuation of Ser. No. 208,665, Dec. 16, 1971, abandoned.

[52] U.S. Cl. ..... 52/79; 52/80; 52/86

[51] Int. Cl.[2] ..... E04B 1/348

[58] Field of Search ..... 52/79, 80, 73, 309, 52/90, 86

[56] References Cited

UNITED STATES PATENTS

| | | | |
|---|---|---|---|
| 3,038,278 | 6/1962 | Hauer | 52/80 |
| 3,455,075 | 7/1969 | Frey | 52/79 |

FOREIGN PATENTS OR APPLICATIONS

| | | | |
|---|---|---|---|
| 1,432,006 | 2/1966 | France | 52/86 |
| 286,229 | 2/1965 | Netherlands | 52/73 |

*Primary Examiner*—John E. Murtagh

[57] ABSTRACT

A single "L"-shaped modular building unit comprises an integral end wall and ceiling and incorporates an outwardly depending flange peripherally surrounding the entire modular unit. The overall ceiling length is equal to twice the ceiling width. The outwardly depending peripherally surrounding flange is rectangular along its exposed edge to provide a modular unit which can be easily interconnected with similar units in any desired arrangement. Along the interior facing edge of the flange, the overall rectangular shape incorporates radii of curvature at the ceiling-wall interface for additional aesthetic purposes. The interconnecting portion between the wall and the ceiling is a saddle-shaped curve extending both longitudinally and laterally substantially the entire length of the ceiling and down a substantial portion of the wall. The peripherally surrounding outwardly depending flange of each modular unit is readily interconnected while the saddle-shaped portion provides structural strength to support the weight of the ceiling. The short open end of the unit is closed with two window, wall, or door units which also acts as a support for that end of the ceiling. Four such units may be used to close the long open ends. Thus, structure of widely varying architecture may be built of more multiple units mounted on a floor, slab or deck.

7 Claims, 29 Drawing Figures

INVENTOR
MARK L. HILDEBRAND
HENRY A. RUDKIN, JR.
NATHANIEL C. WILEY, JR.

MATTERN WARE AND DAVIS
ATTORNEYS

FIG. 22
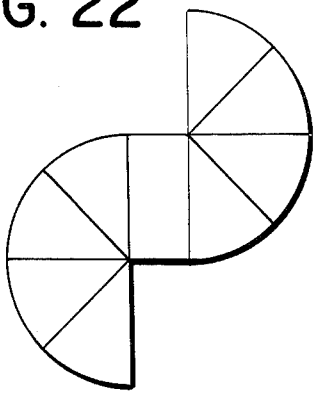
FIG. 23
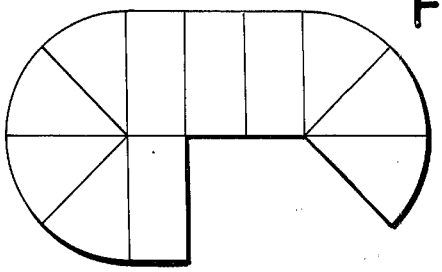
FIG. 24
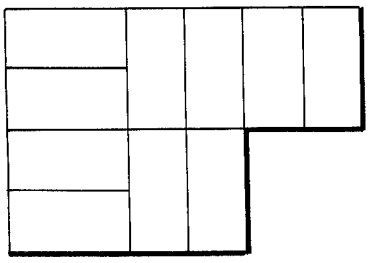
FIG. 25
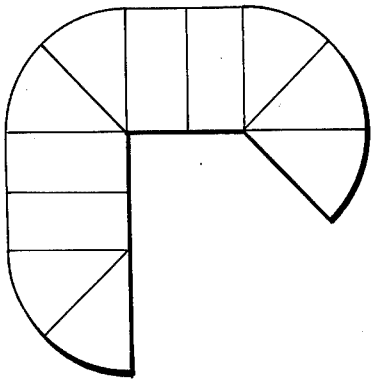
FIG. 26
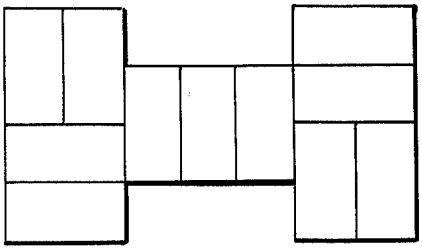
FIG. 27
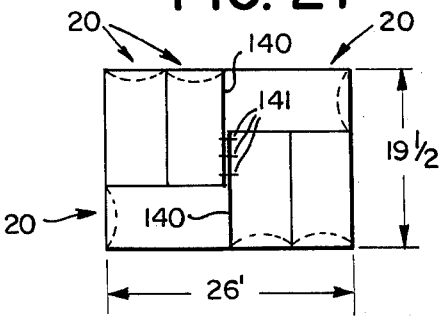
FIG. 28
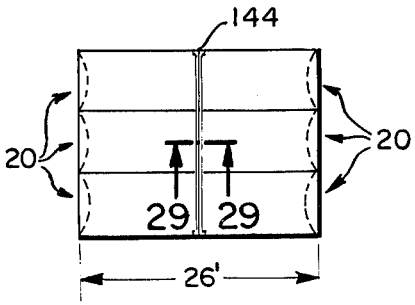
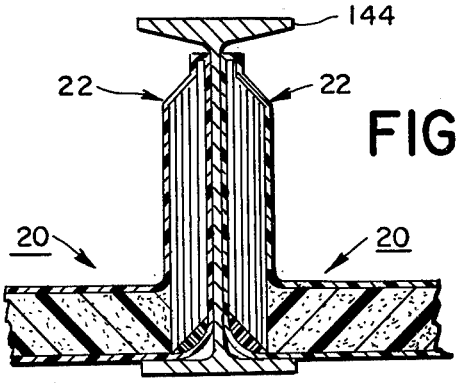
FIG. 29

MODULAR BUILDING UNITS

This is a continuation of application Ser. No. 208,665, filed Dec. 16, 1971 now abandoned.

RELATED APPLICATION

This application discloses matter related to but not claimed in the U.S. Patent application of Henry A. Rudkin, Jr. and Nathaniel C. Wiley, Jr., filed on May 10, 1970 and bearing Ser. No. 141,545 now abandoned.

BACKGROUND OF THE INVENTION

This invention relates to building structures, and more particularly to modular building units for erection on an existing floor construction.

The construction of buildings, especially single family homes, has followed substantially identical patterns for many generations. This well-known construction process of manufacturing individual wooden frameworks for the walls and roof, mounting the proper materials for the inner and outer walls to the wall framework, and roofing material to the roof framework is an extremely expensive operation requiring many man hours to complete.

In order to circumvent some of the drawbacks inherent in the conventional building process, various modularized construction units have entered the building market. Generally, the existing modular products suffer from either of two difficulties. First of all, some modular products are merely component parts for home building or small labor-saving devices which have limited utility and are not capable of making any substantial reduction in the overall hours required to construct a building or the skill required for such construction.

The second difficulty generally befalling the remaining entrants in the prefabricated units are their minimal variability or individuality in the possible ways in which the modules can be interconnected to form a completed structure. These modules have relatively few, if any, variations as to which shape or floor plan arrangements the completed structure can take. As a result, each completed structure is extremely similar to every other structure manufactured from the particular modules, thereby eliminating any individual creativity and promoting monotonous redundancy.

Furthermore, many of the existing prefabricated units are completely constructed and decorated at the plant, before shipment. This type of an arrangement results in expensive shipping costs, since the units cannot be stacked, limitation of sites where modules can be constructed, and trade unions' difficulty when inspection approval of finished plumbing and electrical wiring is sought.

OBJECTS OF THE INVENTION

It is a principal object of this invention to provide a modular building unit which substantially reduces the man hours required to construct a building.

Another object of this invention is to provide a modular building unit of the above character which lends itself to a multitude of construction variations and floor plan arrangements.

Another object of this invention is to provide a modular building unit of the above character which is simple to erect and interconnect with cooperating units and construction hardware to such an extent that an entire building can be constructed by unskilled personnel.

An additional object of this invention is to provide modular building units of the above character which promote individual creativity and avoid completed structure redundancies.

Another object of this invention is to provide a modular building unit of the above character wherein each unit comprises a substantial wall portion and a substantial ceiling portion.

A further object of this invention is to provide a modular building unit of the above character wherein each unit comprises a reinforced foam core surrounded by fiberglass in order to maximize insulation and the strength-to-weight ratio.

Another object of this invention is to provide a modular building unit of the above character which is termite-proof as well as color impregnated, providing low maintenance costs and high weathering capability.

Another object of this invention is to provide a modular building unit of the above character which is capable of being manufactured with a minimum of training.

A still further object of the invention is to provide a modular building unit of the above character which is capable of being stacked for shipment in order to minimize shipping costs.

Another object of this invention is to provide a modular building constructed from the modular units of the above character wherein each building comprises wide and narrow spaces which allow the placement of windows, doors and wall panels virtually anywhere.

Another object of this invention is to provide a modular building of the above character wherein preconstructed window panels, door panels, and wall panels of identical dimensions can be employed throughout as a standard module with no cutting or shaping required.

Other and more specific objects will be apparent from the features, elements, combinations and operating procedures disclosed in the following detailed description and shown in the drawings.

SUMMARY OF THE INVENTION

The modular building unit of this invention comprises a unitary structure, capable of forming a substantial portion of one wall and a substantial portion of the ceiling. Each modular unit also incorporates an outwardly depending flange peripherally surrounding the entire modular unit, and in the preferred embodiment is manufactured with a fiberglass skin surrounding a polyurethane foam core.

The modular unit comprises a concave saddle-shaped portion at the intersection between the wall and ceiling portions. The ceiling decreasingly slopes along the entire ceiling portion until it becomes substantially flat at about 6 inches from the end of the module. Similarly, the saddle-shaped portion decreasingly slopes along the wall portion, blending into a substantially flat portion at about five feet from that end of the module. This aesthetically pleasing wall and ceiling curvature is specifically constructed with structural requirements in mind and provides substantial load-carrying strength to assure complete support of the ceiling portion along with any added weight that the ceiling may be exposed to under heavy wind and snow conditions. Since the slope is away from the outwardly depending flange and towards the center of exterior wall portion, this construction also performs as a large channel for directing water run-off away from the flange and down the center of the exterior wall.

In the preferred embodiment, the sloping curvatures from the flat portion of the ceiling segment to the flat portion of the wall segment is best represented by a family of curved line segments. The module curvature which extends from one side of the module to the other is best represented by a family of curved line segments. This compound curvature and all of its possible variations are best defined as the equilibrium curvature formed when a sheet of elastic material is stretched and peripherally secured to two rectangles intersecting at right angles to each other.

The modular units of this invention are presently manufactured in three different forms with each form comprising a wall section and a ceiling section. The first modular form incorporates substantially rectangular shaped ceiling and wall portions. The ceiling portion comprises a length of 13 feet and a width of 6.5 feet. This two-to-one ratio is extremely important in providing the modular units with great versatility, complete interchangeability, and ready adaptability to virtually unlimited construction arrangement variations.

The second modular unit comprises a curved wall portion with a wedge-shaped ceiling portion. Preferably, the ceiling portion incorporates an over-all shape represented by an isosceles triangle with an included angle of 45°. Each leg of the isosceles triangle is equal to thirteen feet, thereby being readily interconnectible with the rectangular modular unit. Also, the use of an included angle of 45° allows two wedge-shaped modular units to serve as a curved wall right angle corner. The third modular unit is similar to this second unit, except that the wall portion is flat instead of curved. Since all of the modular units incorporate identical wall height and ceiling length, all modules can be interconnected with each other.

The modular units are mounted onto an existing floor structure to create a single story or multiple story dwelling. The floor construction which is provided for the units can take any of the conventional forms, such as slab structure, basement construction, or pile-supported. The bottom outwardly depending flange is interconnected with the flooring structure, while the outwardly depending flanges of each module are easily interconnected with adjacent modules. The remaining areas are enclosed by identical, standardized, pre-constructed window, door and wall panels. The standardized window, wall and door panels can be secured, in any desired arrangement, to both the long and short open sides of the modular unit. These panels provide additional support for the modular unit while also allowing the creation of an aesthetically pleasing construction with a perfect mixture of the warmth provided by walls and the bright airiness provided by windows.

The resulting single story or multiple story dwelling is easily constructed by unskilled laborers and completely alterable by merely disconnecting any particular modules and rearranging them. Furthermore, additional modular units can be added on at a later date in order to accommodate the changing requirements of a growing family.

The modular units of this invention eliminate many of the problems found with existing units. Since the desired dwelling is constructed on site by merely bolting the modular units together, the units can be stacked for shipping, thereby achieving low shipping costs per module. Furthermore, the modules can be manufactured with a minimum of training and a minimum of capital expenditure. Therefore, the modules can be manufactured at many various locations throughout the country to provide prompt as well as inexpensive delivery. Also, the modular construction lends itself to production in depressed areas where skilled labor is difficult or impossible to obtain.

When the modular units have been interconnected to form a particular dwelling, the necessary plumbing and wiring are then installed. This assures that local inspection standards are met, and possible difficulty with trade unions is eliminated.

The invention accordingly comprises the features, elements, combinations and operating procedures hereinafter disclosed, and the scope of the invention will be indicated in the claims.

THE DRAWINGS

For a fuller understanding of the nature and objects of the invention, reference should be had to the following detailed description, taken in connection with the accompanying drawings, in which:

FIGS. 22 through 28 show various selected floor plan arrangements employing the modular building unit of this invention; and FIG. 29 is a cross-sectional side elevation view partially broken away taken along line 29—29 of FIG. 28.

DETAILED DESCRIPTION

Figure 1:
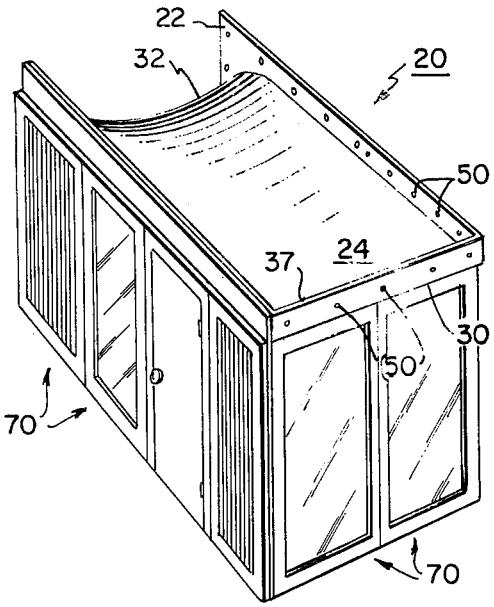
FIG. 1 is a perspective view of one embodiment of the modular building unit of this invention.

Modular building unit 20, best seen in FIGS. 1, 3, 4, and 5, incorporates a ceiling section 24 and a wall section 26. Ceiling section 24 comprises substantially flat portion 28 which extends from front edge 30 of modular building unit 20 a distance which is preferably about 6 inches. The remaining portion of ceiling 24 comprises sloping compound curve portion 32. Curve portion 32 gently slopes into wall section 26, forming a portion thereof along with the substantially flat portion 34 comprising the lower 5 feet of wall section 26. Also, modular building unit 20 incorporates an outwardly depending flange 22 which peripherally surrounds unit 20.

Figure 3:
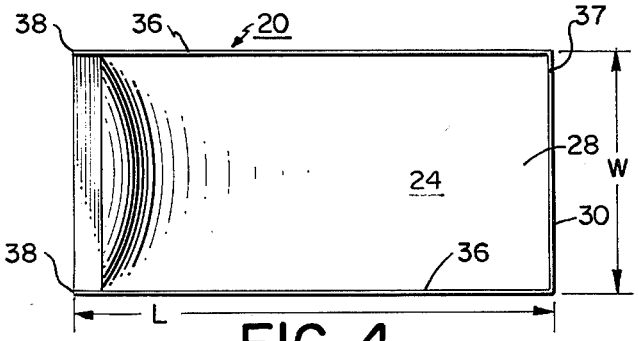
FIG. 3 is a top plan view of the modular building unit of FIG. 1.
Figure 4:
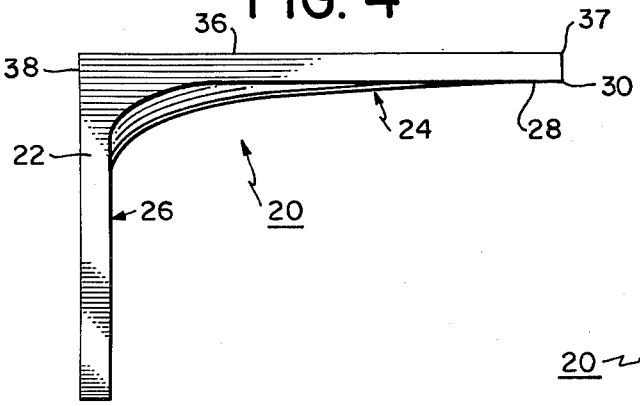
FIG. 4 is a side elevation view of the modular building unit of FIG. 1.
Figure 5:
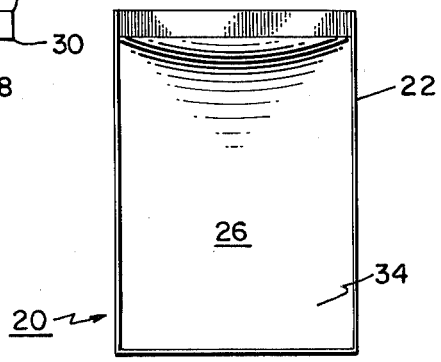
FIG. 5 is a rear elevation view of the modular building unit of FIG. 1.
Figure 6:
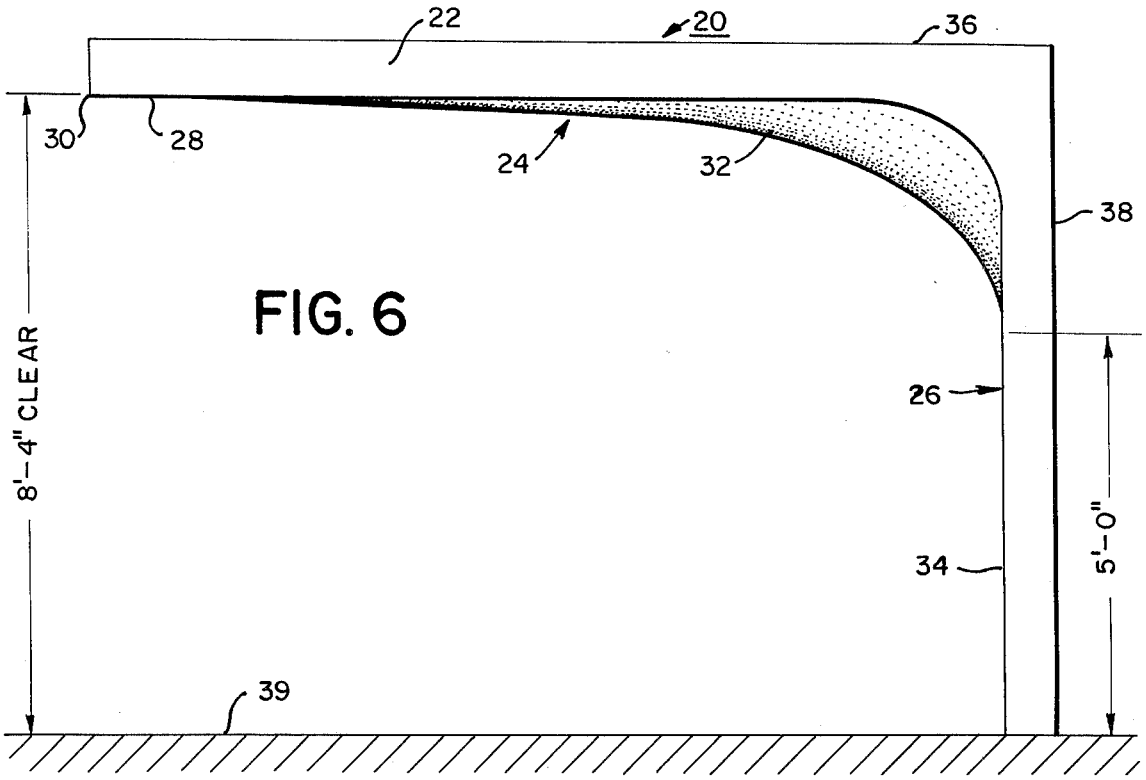
FIG. 6 is an enlarged side elevation view similar to that of FIG. 4.

In FIG. 3, the preferred length-to-width ratio of modular unit 20 can best be seen. By manufacturing modular unit 20 with a length L which is equal to twice the modular unit's width W, the modular unit can be combined in a multitude of different ways. The interconnection of versatility of modular unit 20 is further enhanced by having top edges 36 of flange 22, best seen in FIGS. 3, 4 and 6, substantially perpendicular to side edge 38 of flange 22. This rectangular-shaped flange arrangement allows adjacent modular units to be interconnectible along flange 22 at either both the top and sides or along the top section alone. Also, front top edge 37 is perpendicular to edges 36. Consequently, two modular units 20 can be interconnected to a third unit by placing edge 37 of two of the modules into juxtaposition with one edge 36 of the third module. As best seen in FIGS. 4 and 6, the inside edge of flange 22 is also substantially rectangular in shape, except for the aesthetically pleasing radii of curvature incorporated at the wall-ceiling interface.

Modular units 20 are easily interconnected to each other by mounting bolts in adjacent holes 50, best seen in FIG. 1, in order to securely connect flanges 22 of adjacent units together. Holes 50 are disposed along flange 22 in a predefined pattern which allows easy bolting of adjacent units regardless of the desired unit orientation. The preferred pattern comprises placing holes 50 in flange 22 along edges 36 that are identical to two adjacent hole patterns in flange 22 along edge 37.

In FIG. 1, preconstructed panels 70 are shown mounted to modular unit 20. Every panel 70 is preconstructed with identical dimensions, and is then mounted on either the long or short side of unit 20. In the preferred embodiment, the width W of modular unit 20 is 6 feet 6 inches, and the length L is 13 feet. The width of every interchangeable panel 70 is nominally 3 feet 3 inches, and the completely interchangeable panels are mounted inwardly along the width and outwardly along the length. As is more fully described below, this arrangement allows all panels 70 to have identical dimensions and, therefore, to be completely interchangeable.

The only variations in panels 70 are the types available. As shown in FIG. 1, the three most desirable types are door panels 67, solid panels 68, and window panels 69. These have been found to be the most universally applicable, and can be arranged in any desired configuration along any open wall, since each one is completely interchangeable with the other. Also, in the preferred embodiments, panels 70 are constructed with a width of 3 feet 2-15/16 inches. This provides a sufficient gap for insulation to be placed between abutting panels.

Figure 2:
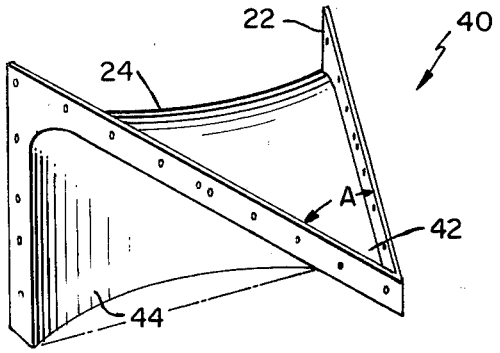
FIG. 2 is a perspective view of a second embodiment of the modular building unit of this invention.

Another embodiment of the modular building unit can best be seen in FIG. 2. Modular building unit 40 incorporates an upstanding peripherally surrounding flange 22 and a curved section 24. The ceiling portion 42 preferably comprises an isosceles triangular shape wherein the angle A is equal to 45 degrees. The flange sections which form the legs of the isosceles triangle are equal to length L of modular unit 20. Wall sections 44 comprises an overall concavely curved shape with section 24 forming an oppositely curved portion thereof. This construction is preferred in order to create a unique effect for providing a 45° angle corner in a particular home by using only two modular units 40. The pattern of holes along flange 22 of unit 40 is identical to the hole pattern along the side flange of unit 20. If desired, however, the wall section could be substantially flat, as is wall portion 26 of unit 20. This construction can best be seen by the lines in phantom in FIG. 23.

Referring to FIG. 6, it is important to note that the distance between front edge 30 of modular unit 20 and floor unit 39 is preferably equal to more than 8 feet. This distance along with the preferred 5 foot height of wall section 34, provides assurance that individuals as tall as 6 feet 6 inches can comfortably stand with their side against wall 26 without hitting their head on sloping portion 32.

Figure 7:
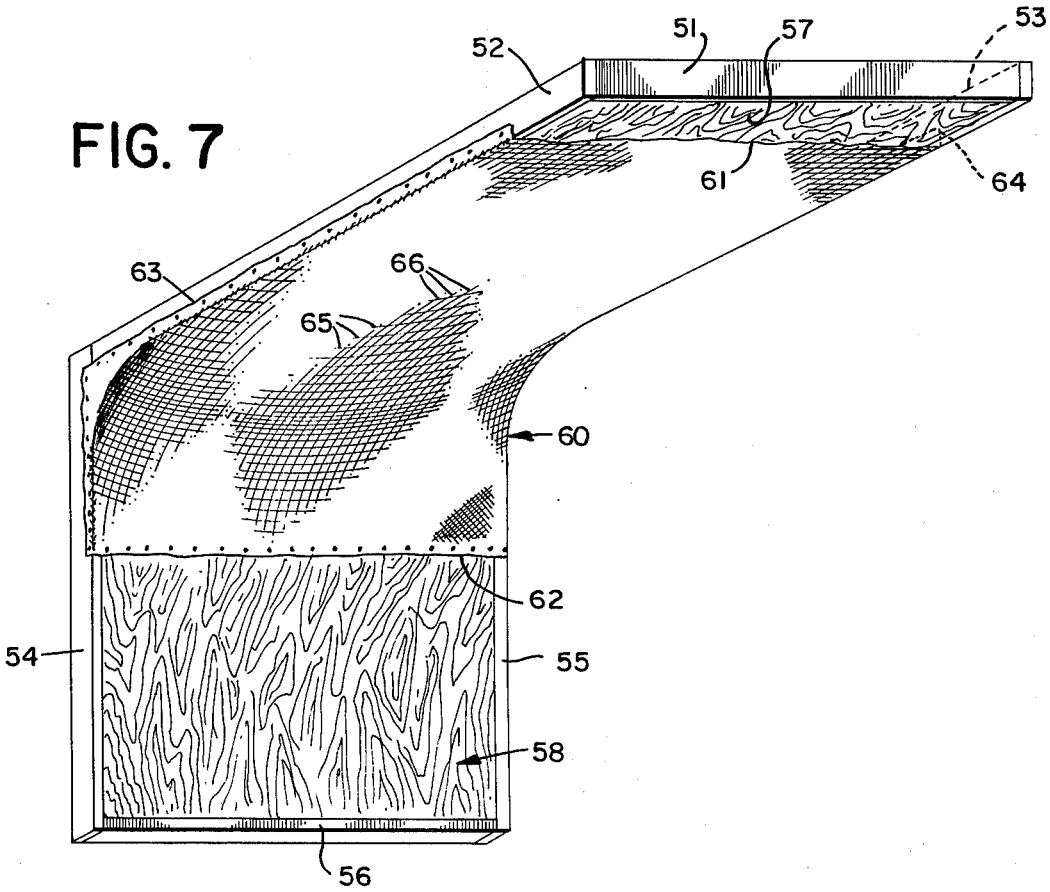
FIG. 7 is a perspective view depicting the construction of the compound curved portion of the modular pattern of this invention.

The evolution and definition of the compound curved portion of the modular units' master patterns of this invention are best understood by referring to FIG. 7. Wooden framework members 51, 52, 53, 54, 55 and 56 are interconnected to each other to form the basic modular framework while also representing the upstanding peripherally surrounding flange 22 of FIG. 1. Plywood section 57 is mounted to member 51 and portions of members 52 and 53, and represents the flat portion 28 of ceiling section 24 of modular unit 20 (FIG. 6). Plywood section 58 is mounted to member 56 and portions of members 54 and 55 and represents substantially flat portion 34 of wall section 26 of modular unit 20.

The compound curved portion of modular unit 20 was developed by peripherally securing elastic material 60 to members 52, 53, 54, and 55, and to plywood sections 57 and 58. In order to completely peripherally secure elastic material 60 to modular framework, material 60 had to be stretched from side to side and top to bottom. This stretching process generated a family of circular line segments extending from edge 61 to edge 62 of material 60. The largest diameter circular line segments are in the area where material 60 is stretched to be mounted to the intersection of studs 52 and 54 and studs 53 and 55. From this largest diameter area, the diameters of the circular line segments slowly decrease in opposite directions until becoming substantially flat at edges 61 and 62.

Running substantially perpendicularly to the family of circular line segments 65 is a family of elliptical line segments 66. Elliptical line segments 66 run parallel to and extend from side 63 to side 64 of elastic material 60. The greatest elliptical curvature is found near sides 63 and 64, with the shallowest elliptical curvature along the midline between sides 63 and 64 of material 60.

An exact mathematical definition of the family of circular line segments and the family of elliptical line segments is not readily obtainable or entirely meaningful. This compound curvature, along with its many variations, is best defined simply as the equilibrium curvature formed by stretching a sheet of elastic material and peripherally securing this material to two rectangles intersecting substantially at right angles to each other. The resulting construction is two rectangular panels substantially perpendicular to each other with an intermediate curved zone concavely arrayed inwardly from the intersection of the panels.

Figure 8:
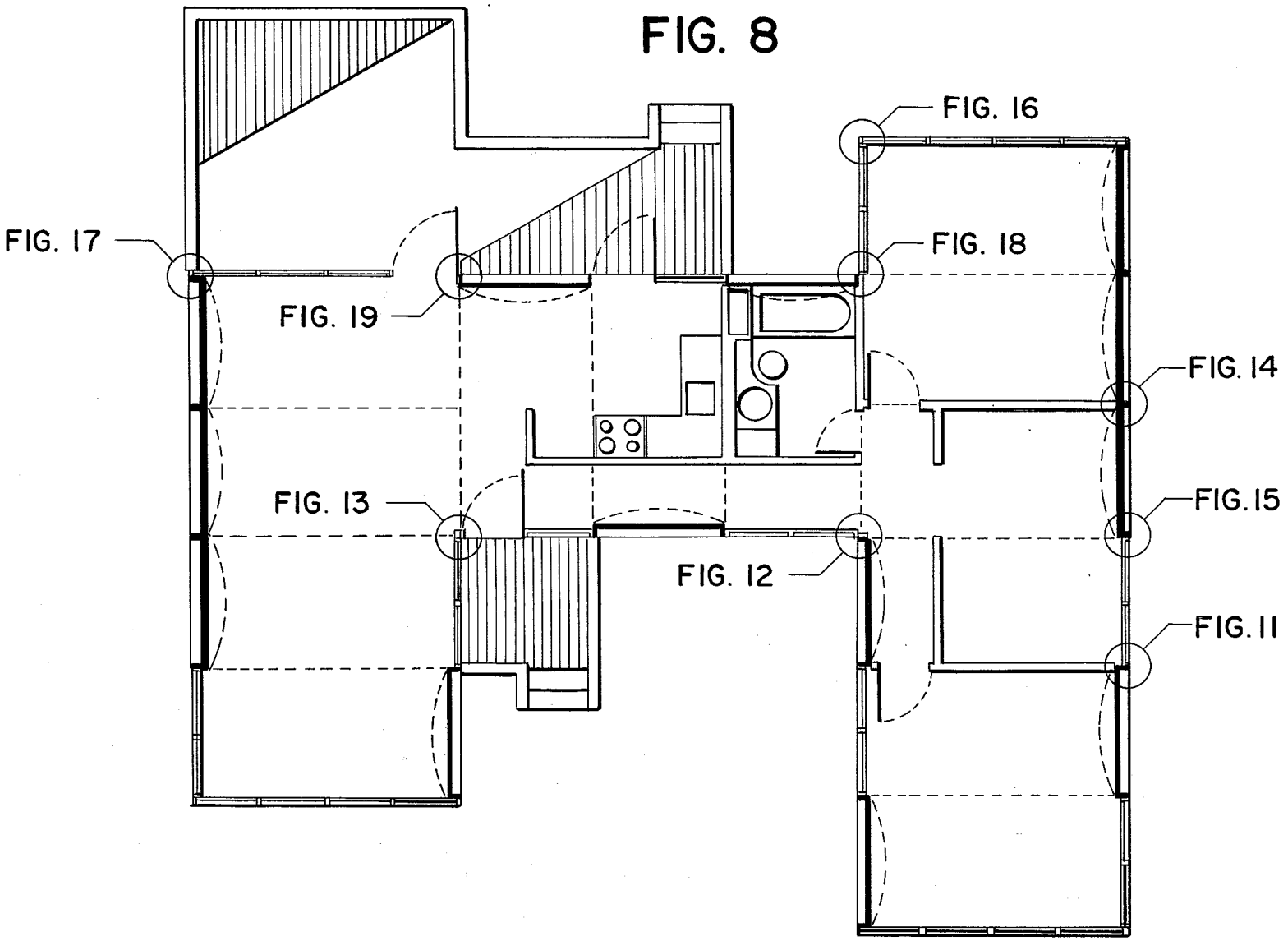
FIG. 8 is a top plan view showing a typical floor plan arrangement for the construction of a dwelling using the modular units of this invention.

In FIG. 8, a typical floor plan of a single story dwelling is shown for exemplary purposes. This particular plan employs 13 modular building units of this invention to provide a spacious living room, dining room, kitchen, bathroom, and three bedrooms. Also shown are optional front and rear wooden decks. A detailed explanation of the typical construction and interconnection requirements for employing the modular units of this invention is found below in the discussion of FIGS. 9 through 21.

Figure 9:
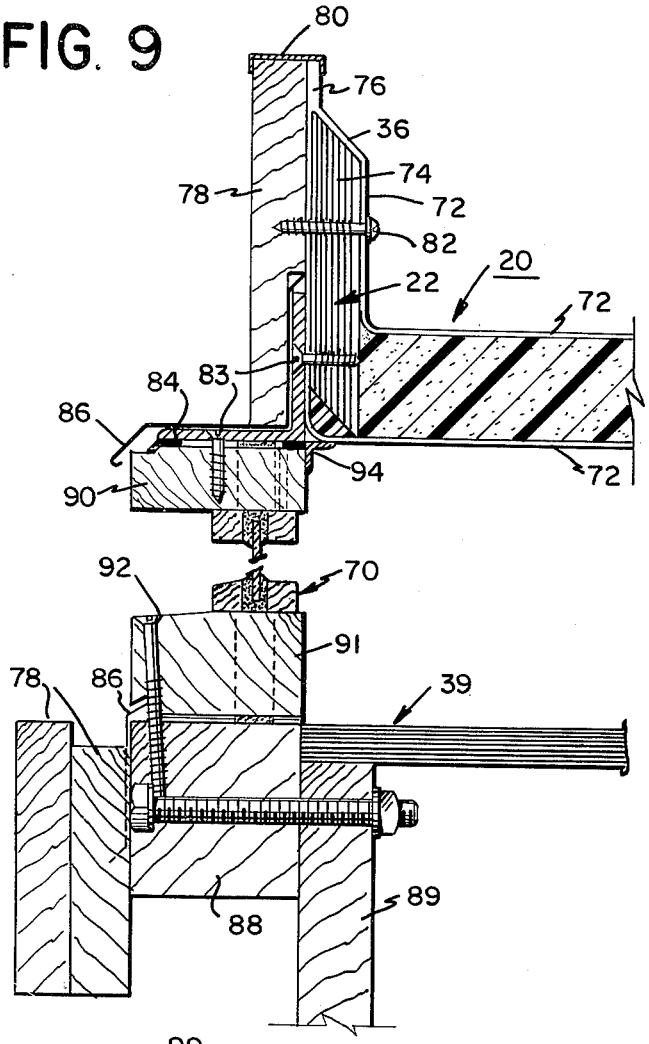
FIG. 9 is a partially cut-away, cross-sectional side elevation view depicting the installation of a preconstructed panel along the long side of a modular building unit of this invention.
Figure 10:
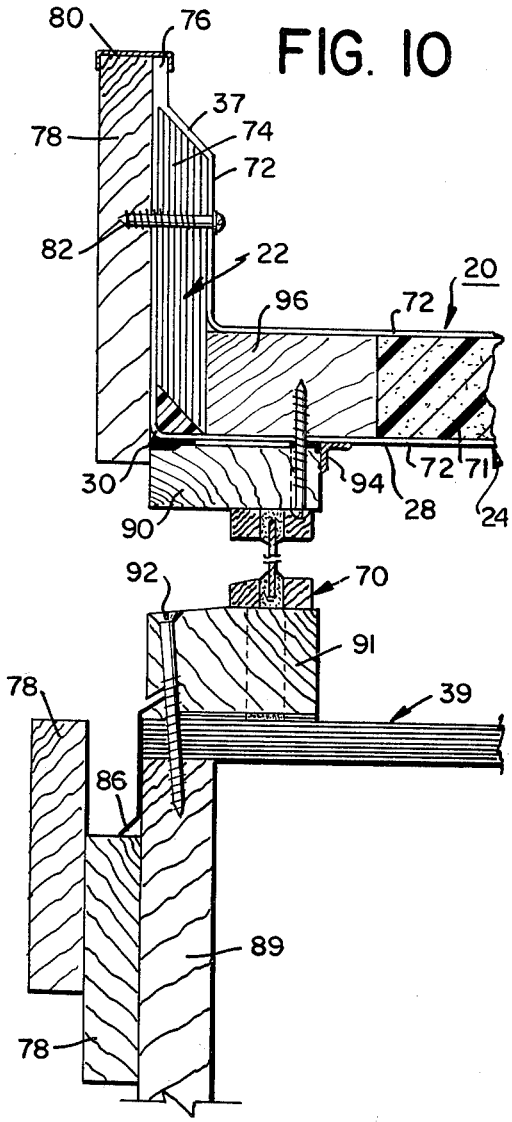
FIG. 10 is a partially cut-away, cross-sectional side elevation view depicting the installation of a preconstructed panel along the short side of a modular building unit of this invention.

The procedure for mounting identical preconstructed window, door, and solid panels to both the long and short open sides of modular unit 20 can best be seen by referring to FIGS. 9 and 10. In these views, it can best be seen that modular unit 20 preferably comprises a foamed polyurethane core 71 surroundingly enclosed by a fiberglass shell 72. The outwardly depending flange 22 of modular unit 20 comprises a wooden core 74 which is peripherally surrounded by fiberglass shell 72. In order to aid draining and prevent water seepage, fiberglass shell 72 is extended beyond the slanted edge of wooden core 74 to provide a fiberglass lip 76. When modular unit 20 is secured to wooden facing 78, cap 80 is placed along the edge of lip 76 and facing 78 to prevent water seepage therebetween.

Wooden facing 78 is preferably secured to flange 22 by means of bolts 82, and nailed in the conventional manner to floor unit 39. While wooden facing 78 is not structurally required, the inclusion of the facing provides an added weather tightness and water shed as well as attractiveness to the completed structure.

In FIG. 9, the attachment of preconstructed panel 70 to the longer open side of modular unit 20 is depicted. In order to secure preconstructed panel 70 to modular unit 20, an angle iron 84 must first be secured to flange 22 by mounting screws 83 in wooden core 74 of flange 22. Also, flashing 86 is mounted along angle iron 84 to provide proper water drainage.

Before panel 70 is mounted in place, wooden sill 88 is bolted to joist 89 of floor unit 39. Panel 70 is then mounted in place just outside of flange 22 of modular unit 20 by securing the top wooden frame 90 of panel 70 to angle iron 84 by means of screws 83 and the bottom wooden frame 91 to sill 88 by means of screws 92. Flashing 86 is also mounted along bottom frame 91 in order to provide the desired drainage. The use of sill 88 is optional, and, if desired, floor unit 39 can be constructed longer so that frame 91 is screwed directly into joist 89.

The construction is completed by bonding a pressure sensitive vinyl strip 94 to wooden frame 90, along the corner where modular unit 20 meets panel 70. This vinyl strip provides an attractive interior molding strip while also hiding possibly unsightly corners. The strip is bonded only to framework 90 in order to allow the different expansion and contraction characteristics of panel 70 and modular unit 20 to occur naturally without pulling or tearing strip 94.

The mounting of preconstructed panel 70 along the short, front open edge of modular unit 20 can best be seen in FIG. 10. Flat portion 28 of ceiling section 24 of modular unit 20 preferably extends from front edge 30 a distance of about 6 inches, and incorporates a wooden core 96 which is surroundingly encompassed by fiberglass shell 72. Wooden core 96 serves as the mounting beam for panel 70.

In order to securely mount panel 70 to modular unit 20, wooden frame 90 of panel 70 is screwed to wooden core 96 of modular unit 20 while bottom frame 91 of panel 70 is screwed to joist 89 of floor unit 39. Once flashing 86 has been secured along bottom framework 91, and pressure sensitive urethane strip is bonded to top frame 90, as previously described, panel 70 is completely installed ready for use.

In FIG. 9 it can be seen that when panel 70 is mounted to the longer side of modular unit 20, panel 70 is positioned beyond the outer surface of flange 22. In FIG. 10, it can be seen that when panel 70 is mounted on the shorter side of modular unit 20, panel 70 is positioned within the outer surface of flange 22 and attached directly to the ceiling section 24 of modular unit 20. As will be more fully described below, this particular construction allows identical panels 70 to be employed for mounting as both the short and long walls. Also, this construction eliminates the need for difficult mitering of abutting corners.

As is obvious to one skilled in the art, all interconnections and abutting mounting surfaces should be fully caulked in the well known manner to provide required weather proofing and eliminate undesirable drafts.

Figure 11:
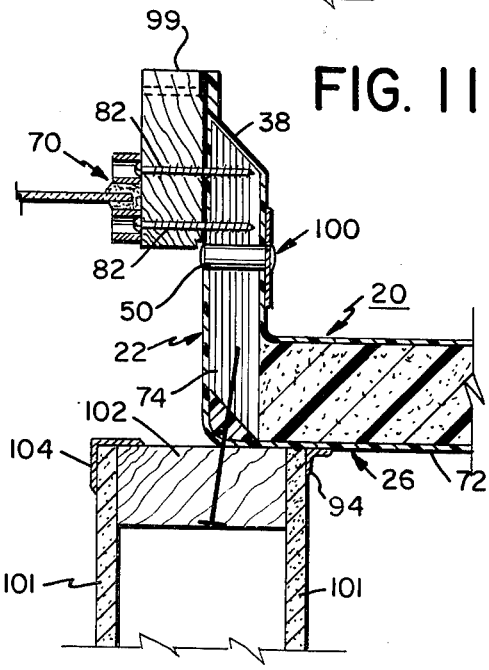
FIGS. 11 through 19 are enlarged detailed top plan views of various construction details for completing the typical dwelling of FIG. 8.

The details of construction for the floor plan of FIG. 8 are shown in FIGS. 11–19. In FIG. 11, the construction details for mounting a preconstructed panel 70 to flange 22 along the side edge 38 can best be seen. Also shown is the arrangement for vertical attaching of interior partitions to modular units 20 when the modular units are facing in opposite directions. Side wooden frame 99 of preconstructed panel 70 is secured in abutting contact with modular unit 20 by mounting screws 82 through frame 99 into wooden core 74 of flange 22. Predrilled hole 50 is closed off by means of plug assembly 100 in order to assure that no moisture will leak into the dwelling.

In order to erect interior walls 101, wood stud 102 is first nailed to the interior edge of wall portion 26 of modular unit 20, by simply driving nails through wooden stud 102 and into wooden core 74 of flange 22. Walls 101 are then nailed to wooden stud 102 in the conventional manner well known in the construction field, and shaped, if necessary, to the curvature of the ceiling portion of modular unit 20. The construction is then completed by bonding vinyl molding strip 94 to fiberglass skin 72 of modular unit 20, and securing wood molding 104 to all exposed, unfinished corners.

Figure 12:
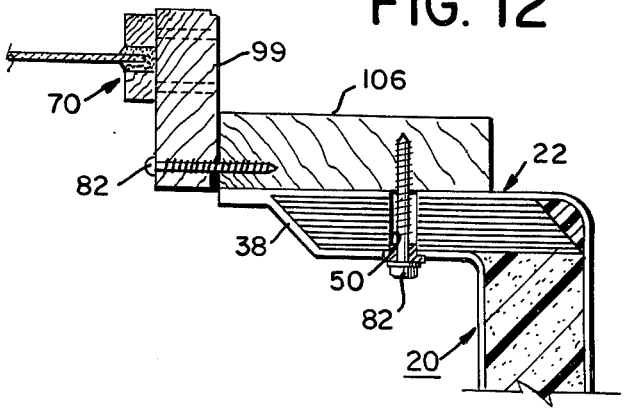

In FIG. 12, the right angle interconnection of modular unit 20 with preconstructed panel 70 can best be seen. This right angle interconnection is easily accomplished by securing, a wooden stud 106 to the outer surface of flange 22 by screwing bolt 82 through predrilled hole 50 into wooden stud 106, using a bushing in pre-drilled hole 50 for a smaller diameter lag screw 82. Preconstructed panel 70 is then easily mounted in the desired position by bolting wooden framework 99 to wooden stud 106.

Figure 13:
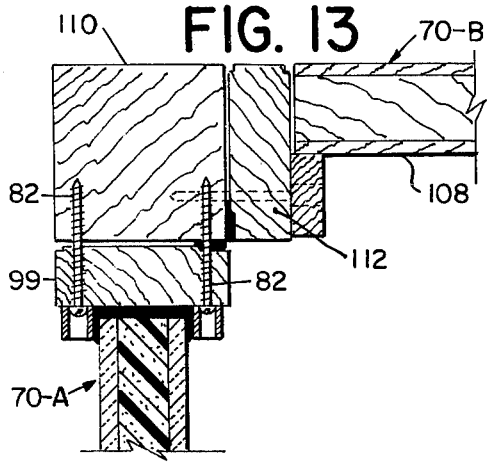

The interconnection of a preconstructed solid panel 70-A to a preconstructed door panel 70-B at right angles to each other is shown in FIG. 13. This corner construction is easily achieved by bolting wooden frame 99 of preconstructed panel 70-A to wooden stud 110 by means of screws 82, and then bolting wooden frame 112 of preconstructed door panel 70-B to wooden stud 110 substantially at right angles to panel 70-A. The door 108 is prehung in panel 70-B, and once the panel 70-B is installed, door 108 is ready for use.

Figure 14:
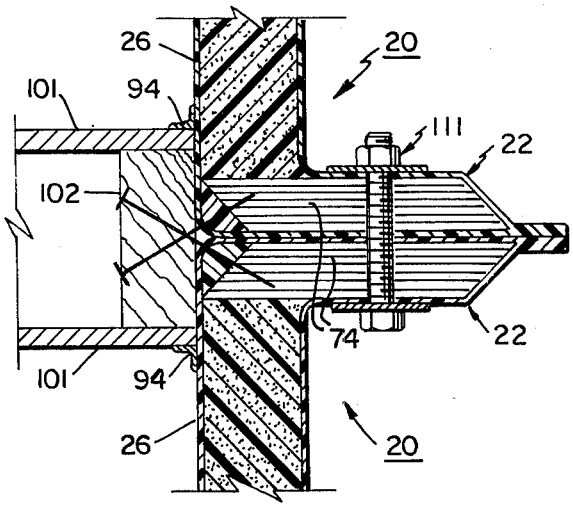

The interconnection of adjacent modular units which face in the same direction and mounting of interior walls thereto is best seen in FIG. 14. Adjacent modular units 20 are quickly secured to each other by fastening bolts 111 through holes 50 of flanges 22. As previously described, interior walls 101 are mounted to wall portion 26 of modular unit 20 by first nailing wooden stud 102 to the wooden cores 74 of flanges 22. Walls 101 are then nailed to stud 102 while vinyl molding strip 94 is secured to modular unit 20, as previously described.

Figure 15:
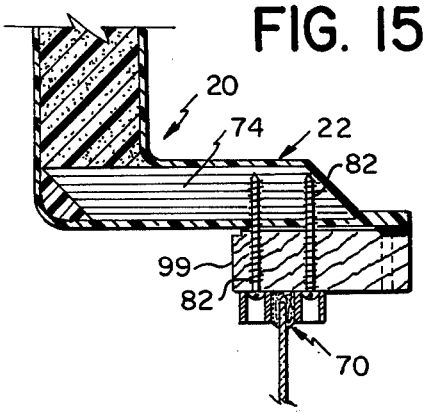

The interconnection of preconstructed panel 70 to the flange side of modular unit 20 is shown in FIG. 15. This construction interconnection is easily achieved by merely securing screws 82 through wooden frame 99 of preconstructed panel 70 and into wooden core 74 of flange 22 of modular unit 20.

Figure 16:
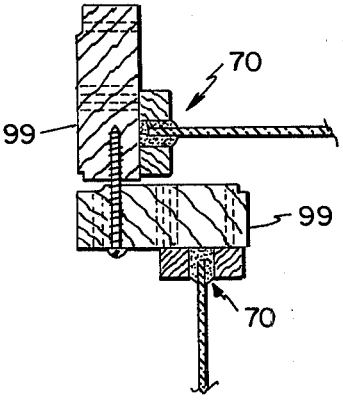

In FIG. 16, the right angle interconnection of two preconstructed panels can best be seen. As previously described, preconstructed panels 70 are mounted outside modular unit 20 along the long sides and inside modular unit 20 along the short edge. As a result, mitering of corners is not required and the right angle interconnection of two panels 70 is quickly achieved by merely bolting wooden framework 99 of one of the panels to wooden framework 99 of the second panel. Panels 70 do not physically intersect each other since each panel 70 comprises identical dimensions and one is mounted interiorly while the other is mounted exteriorly of a modular unit 20.

Figure 17:
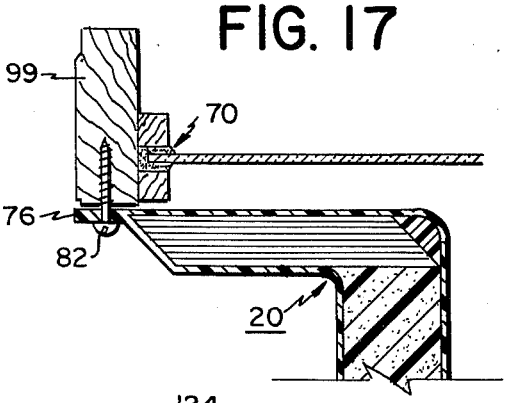

In FIG. 17, the procedure for the exterior mounting of panel 70 to modular unit 20 can best be seen. Preconstructed panel 70 is easily secured to modular unit 20 by merely screwing wooden frame 99 of panel 70 to fiberglass lip 76 of modular unit 20, using screws 82. This exterior mounting of panel 70 to modular unit 20 provides assurance that identical preconstructed panels are effectively employed for both the long and short walls of modular unit 20. Also, as described above, this construction eliminates the requirement for mitered corners while providing for a quickly achieved bolted interconnection.

Figure 18:
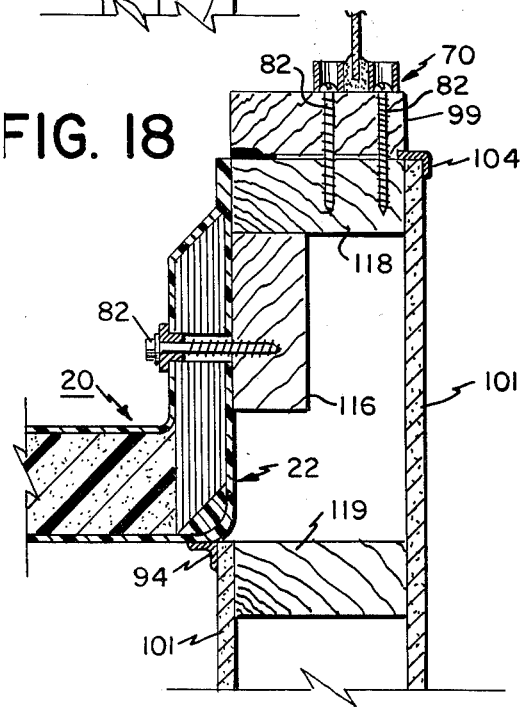

The preferred construction for securing an abutting preconstructed panel and interior wall to modular unit 20 can best be seen in FIG. 18. Wooden stud 116 is first bolted to outwardly depending flange 22 of modular unit 20 and wooden stud 118 is nailed to stud 116. Wooden frame 99 of preconstructed panel 70 is secured to stud 118 by means of screws 82. Then, interior wall stud 119 is erected and wall panels 101 are nailed to studs 118 and 119. Finishing touches are provided by securing vinyl molding strip 94 to modular unit 20, as described above, and nailing molding strip 104 to the exposed edges of wall panel 101.

Figure 19:
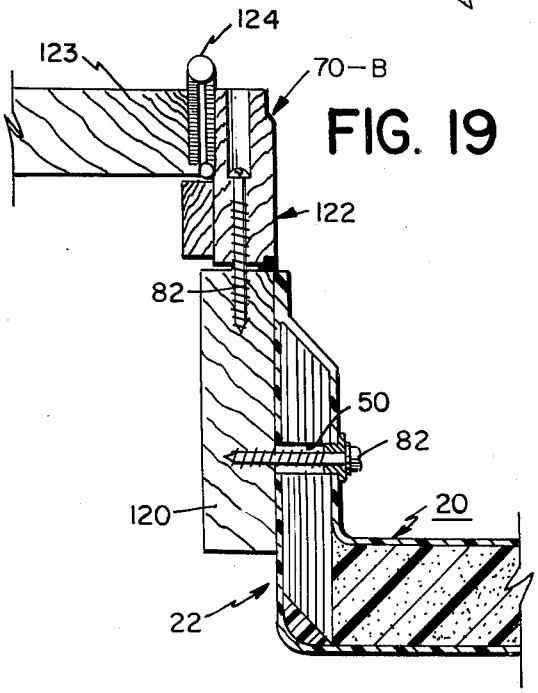

In FIG. 19, the mounting of preconstructed door panel 70-B to modular unit 20 can best be seen. Wooden stud 120 is first mounted to flange 22 of modular unit 20 by securing bolts 82 through holes 50 and into stud 120. Wooden frame 122 of preconstructed door panel 70-B is then bolted to wooden stud 120. A door 123 and hinges 124 are all premounted in panel 70-B, and once preconstructed panel 70-B is secured in place, door 123 is ready for use.

Figure 20:
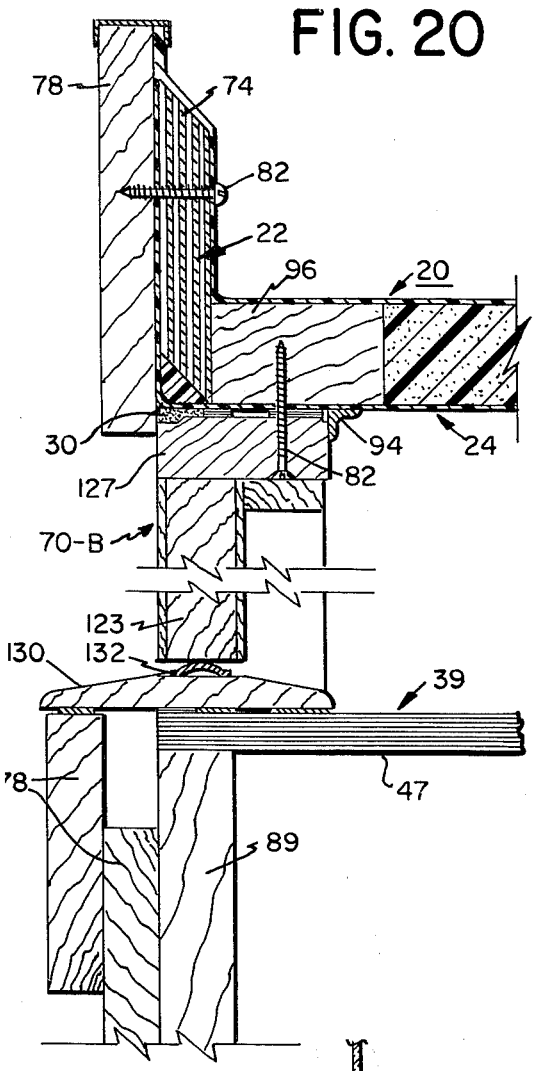
FIG. 20 is a partially cut-away, cross-sectional side elevation view showing the mounting of a door unit along the short side of a modular building unit of this invention.

In FIG. 20, further construction details are depicted for mounting preconstructed door panel 70-B along the short wall of modular unit 20. The securement of door panel 70-B to ceiling section 24 of modular unit 20 is essentially identical to the securement of preconstructed panel 70 as described above in reference to FIG. 10. Top wooden frame 127 of door panel 70-B is secured inwardly of edge 30 of modular unit 20 by mounting screws 82 through frame 127 and into wooden core 96 of modular unit 20. In order to insure proper insulation, door threshold 130 and gasket 132 are placed beneath door 123 of door panel 70-B and then properly shimmed to provide easy door opening as well as complete insulation. When properly positioned, door threshold 130 is secured to plywood subfloor 47 of floor unit 39 and wooden facia 78.

Figure 21:
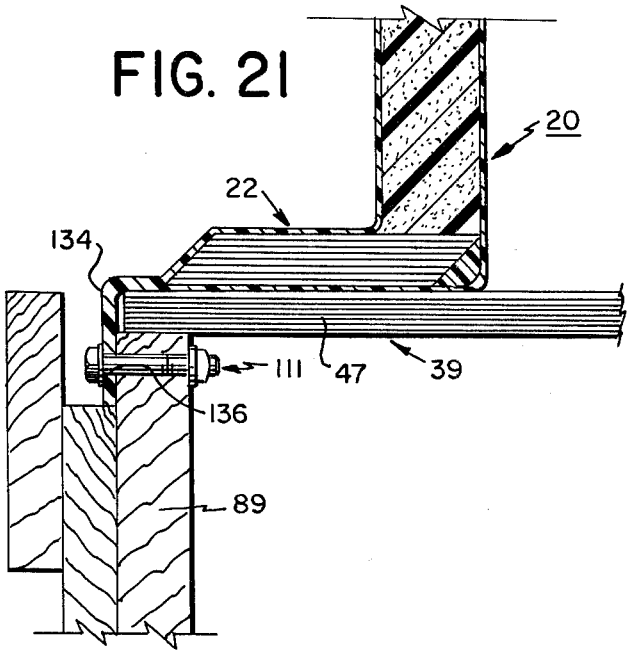
FIG. 21 is a cross-sectional, side elevation view depicting the mounting of the wall portion of a modular building unit to a preconstructed floor.

The interconnection of modular unit 20 with the preconstructed floor unit 39 can best be seen in FIG. 21. As shown therein, outwardly depending flange 22 of modular unit 20 incorporates a right angled lip extension 134 which is provided with holes 136. Modular unit 20 is positioned on floor unit 39 with flange 22 resting on plywood subfloor 47 of unit 39 with lip extension 134 extending beyond subfloor 47 juxtaposed to joist 89 of unit 39. Modular unit 20 is then secured in this position by bolting lip extension 134 to joist 89 using bolts 111.

In FIGS. 22 through 26, various representative dwelling floor plans employing both embodiments of the modular unit of this invention are depicted. While virtually an infinite variety of floor plans can be generated employing the modular units of this invention, the representative plans depicted herein provide some idea of the great variety of individual creativity that can be exercised by one who is desirous of breaking away from housing the design standardization and imitation which permeates the construction industry.

The preferred arrangement of modular units 20 of this invention to provide a single room as large as 26 feet by 19½ feet is depicted in FIG. 27. In order to provide the proper ceiling support for this modular arrangement, reinforcing bars 140 are mounted along the outwardly depending flanges of two of the modular units securely bolted together by bolt units 141 where the two flanges abut each other. These two modular units are selected, since they are the only two units which together completely span one dimension and also abuttingly overlap each other. It is believed that larger open rooms without any additional vertical support would not be feasible since no two flanges can be interconnected with reinforcing bars that will span the entire construction.

In FIG. 28, an additional modular arrangement for providing large open rooms is shown. A plurality of modular units 20 are arranged in pairs with their short, open wall edges abutting each other. Any desired number of modules can be arranged in this manner to provide a room that is 26 feet wide and as long as desired. However, to assure that each modular unit 20 will be provided with sufficient vertical support, I-beam 144 is positioned between and bolted to flanges 22 of modular units 20, best seen in FIG. 29. I-beam 144 is then supported vertically in the conventional manner well known in the art.

Although the modular units of this invention have been described for the construction of a single story dwelling, with the longer section of the unit forming the ceiling and the shorter section forming the wall, it should be obvious to one skilled in the art that the modular units of this invention may also be used for other purposes such as multistory dwelling and split-level dwellings.

Furthermore, dwellings can be constructed by mounting the modular unit on its side and stacking additional units on top. Also, the modular unit can be constructed with the longer section of the unit serving as a wall section and the shorter section of the unit serving as a ceiling section.

It will thus be seen that the objects set forth above, among those made apparent from the preceding description, are efficiently attained and, since certain changes may be made without departing from the scope of the invention, it is intended that all matter contained in the above description shall be interpreted as illustrative so as to obtain the benefit of all equivalents to which the invention is fairly entitled.

It is also to be understood that the following claims are intended to cover all of the generic and specific features of the invention, herein described, and all statements of the scope of the invention which, as a matter of language, might be said to fall therebetween.

Having described our invention, what we claim as new and desire to secure by Letters Patent is:

1. A unitary building module, comprising integrated wall and ceiling portions, which when normally erected comprises:

A. a first integral, solid, opaque, opening-free, substantially vertical wall portion comprising inner and outer substantially parallel planar first surfaces, said first surfaces being about five feet high; the vertical edges of said first surfaces being extended substantially in the planes of said first surfaces above said wall portion forming a first U-shaped member;

B. a second integral, solid, opaque, opening-free, substantially horizontal ceiling portion comprising inner and outer substantially parallel planar second surfaces forming a substantially straight terminating edge and a minor segment of the ceiling portion of said module; the horizontal edges of said second surfaces being extended substantially in the planes of said second surfaces forming a second U-shaped member, and joining said first U-shaped member at right angles forming a framed area thereby;

C. a third integral, solid, opaque, opening-free, joining portion comprising inner and outer substantially parallel anticlastic third surfaces; said third surfaces extending smoothly between and merging with said respective inner and outer first and second surfaces of said wall and ceiling portions and the extended edges thereof, each of said third surfaces conforming to the equilibrium curvature formed by a single sheet of elastic material stretched and attached about its entire periphery in said framed area defined by said first and second U-shaped members at right angles to each other and the respective inner or the respective outer surfaces of said wall and ceiling portions and maintained in tension in said formed area with substantially all points of said elastic material having substantially the same tension; and D. the ratio of the length to the width of said building module measured horizontally being an integer.

2. The unitary building module as defined in claim 1, wherein the length of said module is twice as great as the width of said module.

3. The unitary building module defined in claim 1, wherein said integer ratio is an even integer.

4. A unitary building module, comprising integrated wall and ceiling portions, which when normally erected comprises:

A. a first integral, solid, opaque, opening-free, substantially vertical wall portion comprising inner and outer substantially parallel cylindrical first surfaces, said first surfaces being about five feet high; the vertical edges of said first surfaces being extended substantially in the planes of said first surfaces above said wall portion forming a U-shaped member;

B. a second integral, solid, opaque, opening-free, substantially horizontal ceiling portion comprising inner and outer substantially parallel planar triangularly-shaped second surfaces forming the terminating edge of the ceiling portion of said module; the horizontal edges of said second surfaces being extended substantially in the planes of second surfaces forming a V-shaped member, and joining said U-shaped member at right angles forming a framed area thereby; and C. a third integral, solid, opaque, opening-free, joining portion comprising inner and outer substantially parallel anticlastic third surfaces; said third surfaces extending smoothly between and merging with said respective inner and outer first and second surfaces of said wall and ceiling portions and the extended edges thereof, each of said third surfaces conforming to the equilibrium curvature formed by a single sheet of elastic material stretched and attached about its entire periphery in said framed area defined by said U-shaped member and V-shaped member at right angles to each other and the respective inner or the respective outer surfaces of said wall and ceiling portions and maintained in tension in said framed area with substantially all points on said elastic material having substantially the same tension.

5. A smoothly curved corner arrangement comprising two unitary building modules as defined in claim 4 wherein:

A. the vertical edges along one side of the first surface of one module abutts the vertical edges along one side of the first surface of the second module; and B. the horizontal edges along one side of the second surface of one module abutts the horizontal edges along one side of the second surface of the second module, thereby providing a continuous smoothly rounded, curved, solid corner arrangement.

6. The unitary building module defined in claim 4, in combination with a second unitary building module comprising integrated wall and ceiling portions, which when normally erected comprises:

A. a first integral, solid, opaque, opening-free, substantially vertical wall portion comprising inner and outer substantially parallel planar first surfaces, said first surfaces being about five feet high; the vertical edges of said first surfaces being extended substantially in the planes of said first surfaces above said wall portion forming a first U-shaped member;

B. a second integral, solid, opaque, opening-free, substantially horizontal ceiling portion comprising inner and outer substantially parallel planar second surfaces forming a substantially straight terminating edge and a minor segment of the ceiling portion of said module; the horizontal edges of said second surfaces being extended substantially in the planes of said second surfaces forming a second U-shaped member, and joining said first U-shaped member at right angles forming a framed area thereby;

C. a third integral, solid, opaque, opening-free, joining portion comprising inner and outer substantially parallel anticlastic third surfaces; said third surfaces extending smoothly between and merging with said respective inner and outer first and second surfaces of said wall and ceiling portions and the extended edges thereof, each of said third surfaces conforming to the equilibrium curvature formed by a single sheet of elastic material stretched and attached about its entire periphery in said framed area defined by said first and second U-shaped members at right angles to each other and the respective inner or the respective outer surfaces of said wall and ceiling portions and maintained in tension in said framed area with substantially all points on said elastic material having substantially the same tension; and D. the ratio of the length to the width of said building module measured horizontally being an integer, wherein the vertical edges along one side of the first surface of the first building module abutts the vertical edges along one side of the first surface of the second module and the horizontal edges along one side of the second surface of the first module abutts the horizontal edges along one side of the second surface of the second module.

7. The combination of unitary building modules defined in claim 6, wherein the wall portions of said modules face in opposite directions, and a portion of the horizontal edges along one side of the second surface of the first module abutts a portion of the horizontal edges along one side of the second surface of the second module.

* * * * *